United States Patent [19]

Sakamaki et al.

[11] Patent Number: 4,594,062

[45] Date of Patent: Jun. 10, 1986

[54] VANE TYPE ROTARY COMPRESSOR WITH ROTARY SLEEVE

[75] Inventors: Hiroshi Sakamaki, Tochigi; Susumu Sugishita, Saitama; Yukio Horikoshi, Saitama; Kikuji Yanagihashi, Saitama, all of Japan

[73] Assignee: Nippon Piston Ring Co., Ltd., Tokyo, Japan

[21] Appl. No.: 559,814

[22] Filed: Dec. 9, 1983

[30] Foreign Application Priority Data

Dec. 11, 1982 [JP] Japan ..... 57-216296

[51] Int. Cl.[4] ..... F04C 18/348

[52] U.S. Cl. ..... 418/173

[58] Field of Search ..... 418/152, 172, 173, 174, 418/270; 308/DIG. 1; 384/109; 432/132

[56] References Cited

U.S. PATENT DOCUMENTS

| | | | |
|---|---|---|---|
| 1,162,962 | 12/1915 | Wilson | 418/172 X |
| 2,665,056 | 1/1954 | Orban | 418/152 |
| 3,063,041 | 11/1962 | Quade et al. | 384/109 X |
| 4,177,024 | 12/1979 | Lohn | 418/270 |
| 4,479,763 | 10/1984 | Sakamaki et al. | 418/173 |

OTHER PUBLICATIONS

Chironis, N.; Gas Bearings; Product Engineering; Nov. 23, 1959; pp. 68–70.

*Primary Examiner*—Leonard E. Smith

*Attorney, Agent, or Firm*—Birch, Stewart, Kolasch & Birch

[57] ABSTRACT

A rotary compressor provided with a center housing and side housings, a rotary sleeve mounted for rotation in the housings and a plurality of vanes radially, slidably fitted in a rotor which is eccentrically disposed in the rotary sleeve. The rotary sleeve has its opposite side surfaces formed with a plurality of air-guide grooves. As the rotary sleeve rotates, the air-guide grooves guide air to flow from the compression working space in the rotary sleeve to the air-bearing room between the outer periphery of the rotary sleeve and the inner periphery of the center housing and from the air-bearing room to the suction working space in the rotary sleeve so that an air film is formed in each of the both side clearances between the both side surfaces of the rotary sleeve and the inner surfaces of both side housings.

5 Claims, 10 Drawing Figures

VANE TYPE ROTARY COMPRESSOR WITH ROTARY SLEEVE

BACKGROUND OF THE INVENTION

1. Field of the Invention

The present invention relates to a rotary compressor that is provided with a center housing, front and rear side housings, and a rotary sleeve mounted in the center housing for rotation with a plurality of vanes radially slidably fitted in a rotor which is eccentrically disposed in the rotary sleeve. More particularly, the present invention relates to a compressor that is improved in starting characteristics and utilizable as a supercharger for an internal combustion engine.

2. Description of the Prior Art

In Japanese Published Unexamined Patent Application No. 58-65988 published on Apr. 19, 1983, is shown a rotary compressor provided with a rotary sleeve interposed between a center housing and a rotor and floatingly supported by compressible fluid. The compressor is particularly suitable for a supercharger with use for an automobile engine required to operate over a wide range of speeds. The rotary sleeve rotates together with the vanes to remove frictional heat as well as wear at the apex of each vane. However, there is the possibility of that wearing will cause a problem when the rotary sleeve has one of its opposite side surfaces in frictional contact with the inner surface of the side housing.

SUMMARY OF THE INVENTION

The primary object of the invention is to provide a rotary compressor in which the rotary sleeve is mounted in a center housing for rotation with a plurality of vanes and is prevented from directly contacting the inner surface of the side housing.

To accomplish the object as described, the compressor of the present invention comprising a center housing, front and rear side housings, a rotary sleeve mounted in the center housing for rotation with a plurality of vanes radially, slidably fitted in a rotor which is eccentrically disposed in the rotary sleeve, discharge and suction chambers, and an air bearing room defined between the outer periphery of the rotary sleeve and the inner periphery of the center housing and supplied with air compressed in the compressor, is characterized in that a plurality of air-guide grooves are formed in the side surfaces of the rotary sleeve. The air-guide grooves are separated from one another to convey air into a clearance between the rotary sleeve and each of the front and rear side housings and to form an air-film therebetween as the rotary sleeve rotates. Oil free bearing members are preferably embedded in the inner surfaces of both side housings to prevent direct contact therebetween during the starting time.

The advantages offered by the present invetion are mainly that the opposite side surfaces of the rotary sleeve and the inner surfaces of the both side housings are free from wear tear.

The other objects and advantages of the present invention will become apparent from the following detailed description of the invention in conjunction with the attached drawings.

DETAILED DESCRIPTION OF THE PREFERRED EMBODIMENTS

Figure 1:
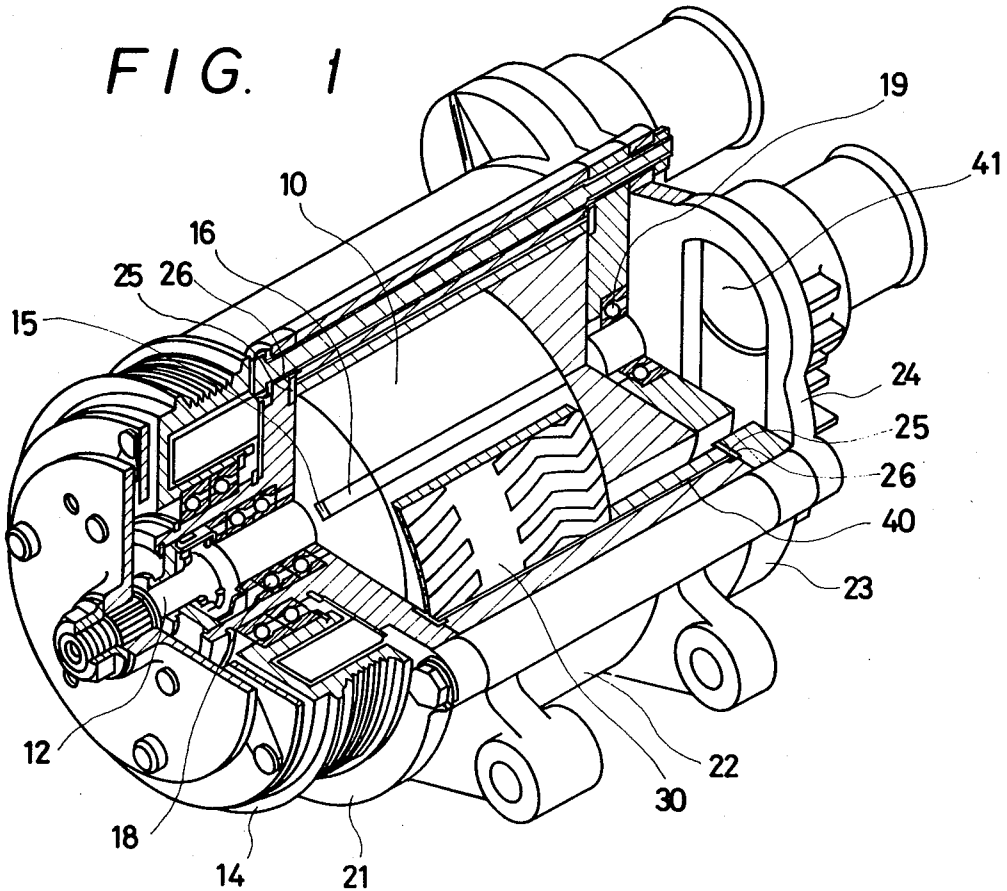
FIG. 1 is a perspective view of an embodiment of the present invention with a portion thereof being broken away to reveal the inside of the rotary compressor.

The compressor of the present invention is described in detail below with reference to the drawings. Referring initially to FIG. 1, the compressor has a rotor 10 integrally provided with a rotary shaft 12, which is rotatably supported by bearings 18, 19 in the respective front and rear side housings 21, 23 and fixed at the front end to a pulley 14 which is rotated by a non-illustrated engine. A plurality of vanes 16 are radially slidably fitted in the respective vane grooves 15 in the rotor 10 and have their apex in contact with the inner periphery of a rotary sleeve 30. The rotary sleeve 30 is mounted within the center housing 22 to define an air-bearing room 40 of 0.02–0.15 mm width therebetween. A gasket is interposed between the rear side housing 23 and the rear cover 24 in which a discharge chamber 41 and a non-illustrated suction chamber are provided. Oil free bearing members 25 are embedded in the respective annular grooves 26 in the both side housings 21, 23 for smooth contact with the side surface of the rotary sleeve 30.

Figure 2:
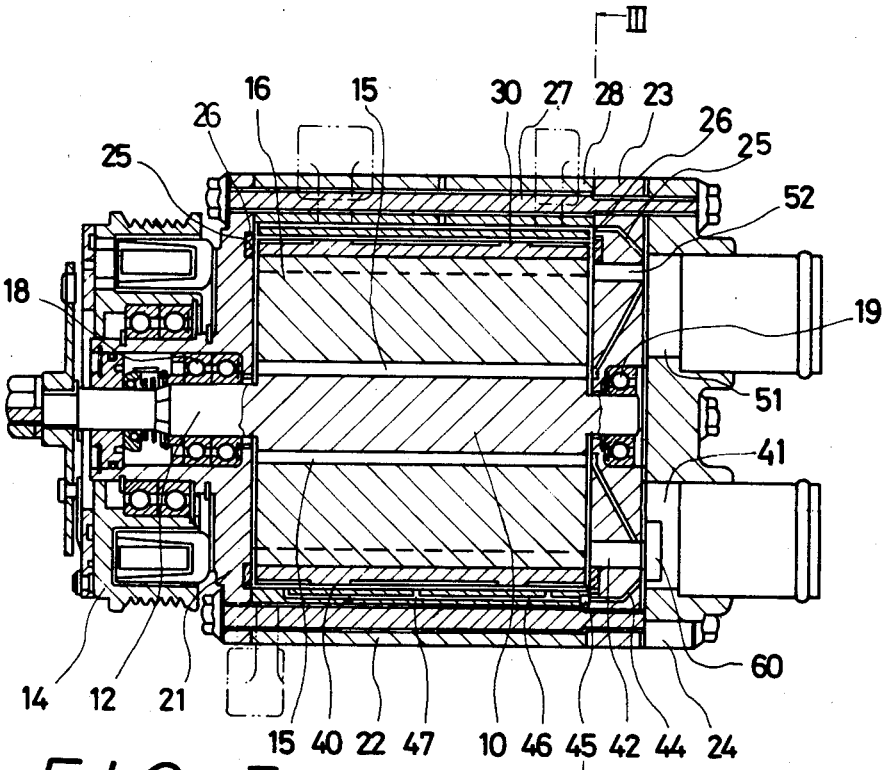
FIG. 2 is an axial sectional view of the compressor of FIG. 1.

As seen in FIG. 2, each vane 16 radially projects from the vane groove 15 in the rotor 10 and has its apex in contact with the inner periphery of the rotary sleeve 30. The discharge chamber 41 is internally connected through a discharge valve 60 to a discharge port 42 and the suction chamber 51 is internally connected to a suction port 52. The rear side housing 23 is formed with a high-pressure hole 44 extending from the discharge valve 60 to high-pressure groove 45 in the joining surface between the center housing 22 and the rear side housing 23. Center housing 22 is formed with a high-pressure passage 46, which extends axially from the high-pressure groove 45. The high-pressure passage 46 is provided with a plurality of throttles 47 opened to an air-bearing room 40 between the inner periphery of the center housing 22 and the outer periphery of the rotary sleeve 30. Thus, the discharge chamber 41 is internally connected to the air-bearing room 40. Bolts 27 pass through the thickened portions 28 of the center housing 22, the front and rear side housings 21, 23, and the rear cover 24 fastening them axially as one body. The front and rear side housings 21, 23 are formed in the inner surfaces with annular grooves 26 in which the oil free bearing members 25, made of carbon, alumina, silicon nitride or the like, are embedded for smooth contact with the respective side surfaces of the rotary sleeve 30. The ball bearings 18, 19 support the rotary shaft 12, which is removably connected to the pulley 14 with the intervention of an electromagnetic clutch.

Figure 3:
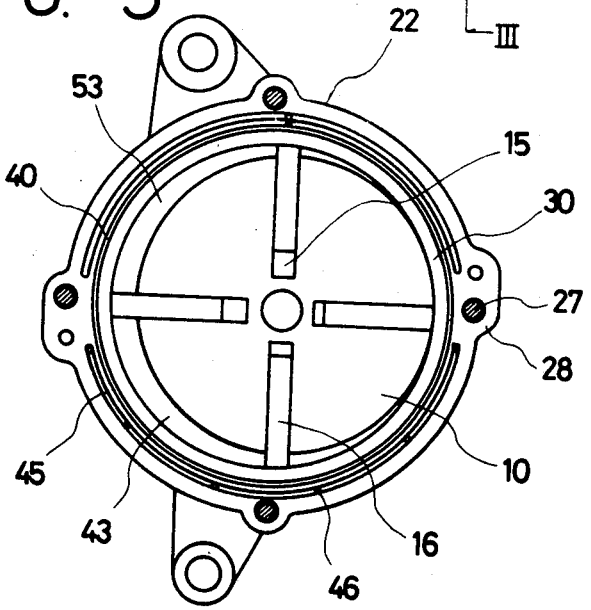
FIG. 3 is a taken along line III—III of FIG. 2.

As seen in FIG. 3, the high-pressure passages 46 are disposed on the high-pressure groove 45 which forms a circular arc having a subtended angle of about 170 degrees in the compression side of the compressor. The air-bearing room 40 defined between the inner periphery of the center housing 22 and the outer periphery of the rotary sleeve 30 floatingly support the rotary sleeve 30. Four vanes 16 fitted in the vane grooves 15 confine the suction working space 53 in the suction side and the compression working space 43 in the compression side, together with the outer periphery of the rotor 10 and the inner periphery of the rotary sleeve 30. Four bolts 27 are circularly, equidistantly disposed in the thickened portions 28 of the center housing 22.

Figure 4:
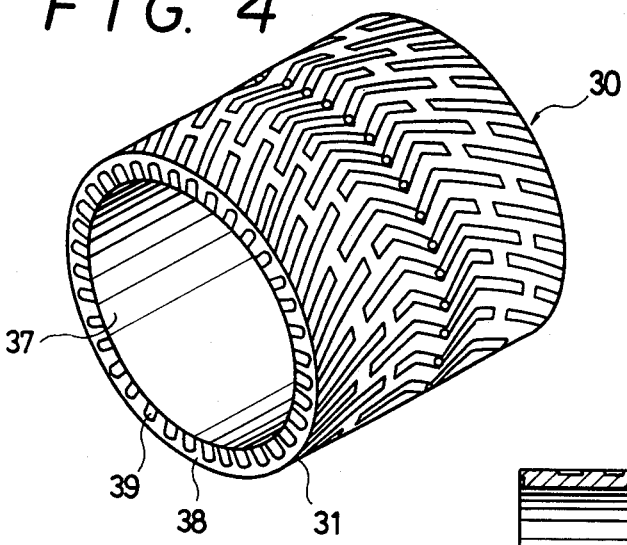
FIGS. 4 and 5 are perspective and sectional views of the rotary sleeve of FIG. 1.
Figure 5:
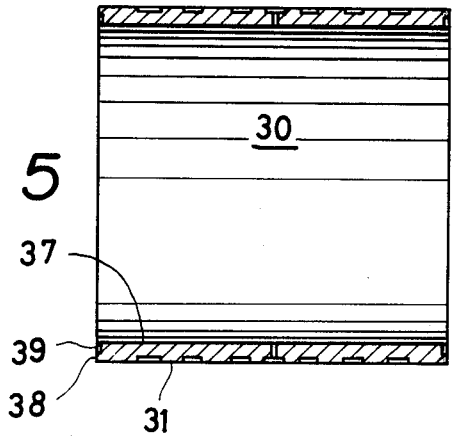

As seen in FIGS. 4 and 5, a plurality of radial air-guide grooves 39 are provided in the opposite side surfaces 38 of the rotary sleeve 30 by an electrolytic etching or shot-blast method. The air-guide grooves 39 are symmetrical to the center axis of the rotary sleeve 30 and separated from one another, each extending from the inner periphery 37 of the rotary sleeve into the vicinity of the outer periphery 31 of the rotary sleeve 30.

Figure 6:
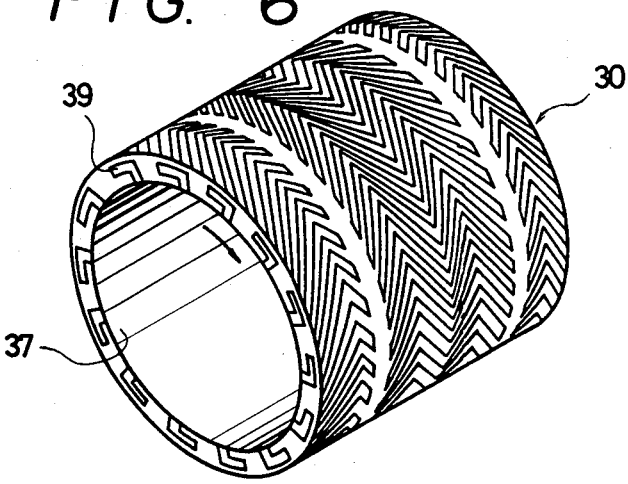
FIGS. 6 and 7 are perspective views of other embodiments of the present invention, similar to FIG. 4.
Figure 7:
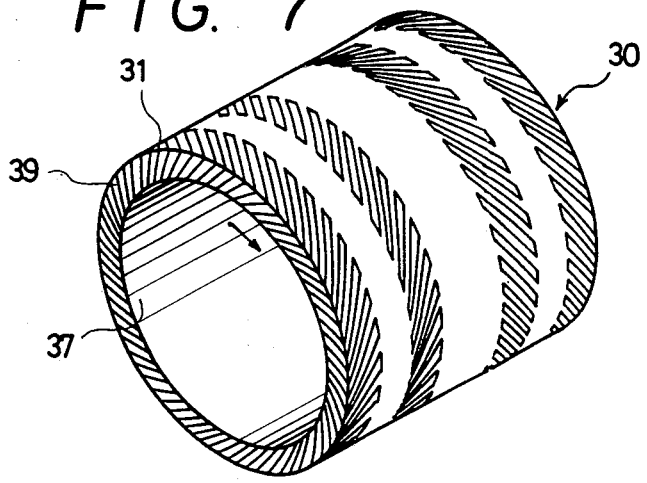
Figure 8:
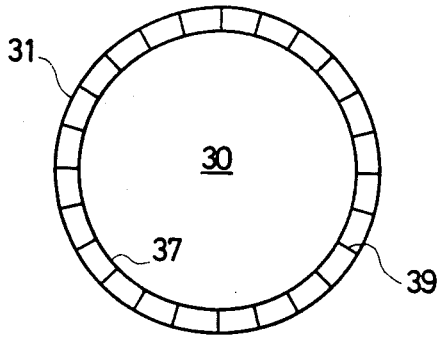
FIGS. 8 to 10 are end views of different embodiments of the present invention.
Figure 9:
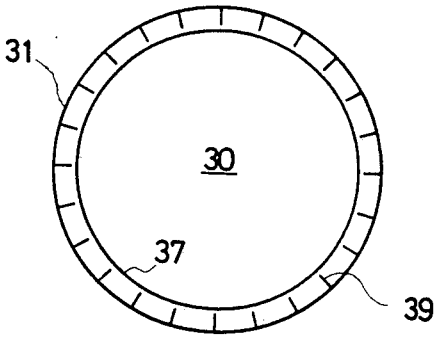
Figure 10:
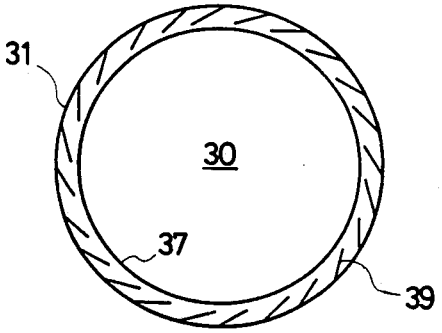

The air-guide groove can be shaped in a variety of forms as seen in FIGS. 6 to 10. The rotary sleeve 30 has its air-guide grooves 39 each being relatively wide and extending radially from the inner periphery 37 to turn in the the peripheral direction opposite to the rotational direction shown by an arrow, as seen in FIG. 6. The rotary sleeve 30 has the air-guide grooves 39 each being relatively wide and inclined to the rotaional direction shown by an arrow and extending from the inner periphery 37 to the outer periphery 31, as seen in FIG. 7. The rotary sleeve 30 can have a variety of thin radial air-guide grooves 30 extending from the inner periphery 37 to the outer periphery 31, as seen in FIG. 8. As seen in FIGS. 9 and 10, the thin radial or slanting air-guide grooves 39 extend from the vicinity of the inner periphery 37 to the outer periphery 31 of the rotary sleeve 30.

In operation, the rotation of the engine is transmitted to the rotor 10 by the pulley 14. The rotor 10 rotates slowly in the initial time, in which compressed air in the compression working space 43 flows out through both clearances among the rotary sleeve 30 and the front and rear side housings 21, 23 into the air-bearing room 40. On the other hand, air enters the suction working space 53 along the air-guide grooves 39 from the air-bearing room 40. The air flowing among the air-bearing room 40 and the compression and suction working spaces 53, 43 forms a fluidic film between the opposite side surfaces 38 and the respective oilless bearing members 25 embedded in the front and rear side housings 21, 23 to provide an air thrust bearing effect that permits the rotary sleeve 30 to rotate without contacting the front and rear side housings 21, 23. Air is centrifugally forced out of the inside of the rotary sleeve 30 to the air-bearing room 40 along the air-guide grooves 39 at high running speed to form a fluidic film between the opposite side surfaces 38 and the respective oilless bearing members 25 embedded in the front and rear side housings 21, 23 and produce an air thrust bearing effect that permits the rotary sleeve 30 to rotate without contacting the front and rear side housings 21, 23. The relatively wide air-guide groove 39 is suitable for high-speed running compressors because it has the effect of producing a relatively large air-flowing from the rotary sleeve 30 to the air-bearing room 40 when the rotor rotates at high speeds.

The rotary sleeve 30 and the front and rear side housings 21, 23 make no contact with each other while the rotor 10 rotates, so that there will occur no wearing due to sliding friction between the side surface of the rotary sleeve 30 and the inner surface of the side housings 21, 23. The annular oilless bearing members 25 are embedded in the annular grooves 26 in the inner surfaces of the front and rear side housings 21, 23 to prevent the side surfaces 38 of the rotary sleeve 30 from wearing. The rotary sleeve 30 is in contact with one of the side housings 21, 23 when it stops, so that it is unavoidable to rotate in contact with the side housing during the starting period. But, the rotary sleeve 30 is protected against wearing by the oilless bearing members 25. Once the rotor 10 rotates, the air-guide grooves 39 soon bring an air thrust bearing effect to protect the side surfaces 38 of the rotary sleeve 30 as well as the oilless air-bearing members 25 against wear.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rotary compressor comprising a center housing and front and rear side housings, a rotary sleeve rotatably mounted in said center housing and front and rear side housings, a rotor eccentrically disposed in said rotary sleeve, said rotor containing a plurality of vanes which are radially and movably fitted therein, and a plurality of air-guide grooves formed in the opposite side surfaces of said rotary sleeve and peripherally separated from each other, said air-guide grooves extending radially from the inner periphery of said rotary sleeve to the outer periphery of said rotary sleeve.

2. The rotary compressor as claimed in claim 1, wherein said air-guide grooves extend in an inclined manner from the inner periphery of said rotary sleeve to the outer periphery of said rotary sleeve.

3. The rotary compressor as claimed in claim 2, wherein said air-guide grooves extend in an inclined manner in the rotational direction of said rotary sleeve from the inner periphery of said rotary sleeve to the outer periphery of said rotary sleeve.

4. The rotary compressor as claimed in claim 1, wherein said front and rear side housings have the inner surfaces thereof provided with oiless bearing members for sliding engagement with the side surface of said rotary sleeve.

5. The rotary compressor as claimed in claim 4, wherein said bearing member is made of carbon.

* * * * *